US007753041B2

(12) United States Patent
Ogawa

(10) Patent No.: US 7,753,041 B2
(45) Date of Patent: Jul. 13, 2010

(54) CROSSBOW

(76) Inventor: Tsuyoshi Ogawa, 509-1, Santo-cho Mizoguro, Asago-shi, 669-5132 (JP)

( * ) Notice: Subject to any disclaimer, the term of this patent is extended or adjusted under 35 U.S.C. 154(b) by 360 days.

(21) Appl. No.: 11/822,802

(22) Filed: Jul. 10, 2007

(65) Prior Publication Data

US 2008/0141989 A1 Jun. 19, 2008

(30) Foreign Application Priority Data

Nov. 10, 2006 (JP) ..... 2006-304702

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS

| | | | | |
|---|---|---|---|---|
| 3,017,874 | A * | 1/1962 | Gubash | 124/25.7 |
| 3,670,711 | A * | 6/1972 | Firestone | 124/25 |
| 4,565,182 | A * | 1/1986 | Barnett | 124/25 |
| 4,662,345 | A * | 5/1987 | Stephens | 124/25 |
| 5,544,641 | A * | 8/1996 | Jenn | 124/25 |
| 6,868,845 | B1 * | 3/2005 | Moore | 124/25 |
| 6,874,491 | B2 * | 4/2005 | Bednar | 124/25 |

FOREIGN PATENT DOCUMENTS

| | | |
|---|---|---|
| JP | 58-52498 U | 4/1983 |
| JP | 61-79793 U | 5/1986 |

* cited by examiner

*Primary Examiner*—John Ricci
(74) *Attorney, Agent, or Firm*—Smith Patent Office

(57) ABSTRACT

A crossbow that enables arrows to be shot with simple operation is provided. The crossbow includes a bow stock that has a fitting recess for a cylinder formed between a front end and a rear end thereof, a bow that is attached to the front end of the bow stock thereacross, and has a string tensioned between both ends thereof, a wire catch that is rockably provided at the rear end of the bow stock to hook the tensioned string, a trigger that is provided at the rear end of the bow stock to cock the wire catch that has hooked the string and to release the cocking of the wire catch by triggering, thereby shooting an arrow, a cylinder that is rotatably fitted in the fitting recess of the bow stock, and has a plurality of arrow grooves formed at predetermined angular intervals in an outer peripheral surface thereof so as to extend in a longitudinal direction, and has arrows slidably inserted in the plurality of arrow grooves, respectively, and a rotation operating mechanism that rotates the cylinder at every predetermined angle, and locates one arrow groove in front of the wire catch.

3 Claims, 11 Drawing Sheets

CROSSBOW

BACKGROUND OF THE INVENTION

1. Field of the Invention

The present invention relates to a crossbow, and specifically, to a crossbow that enables arrows to be continuously shot with simple operation.

2. Discussion of the Related Art

It is considered that a crossbow originates in the Eastern crossbow that appeared around the fifth century B.C., and has become almost the current shape in Europe around the twelfth century.

In this crossbow, a method of attaching a bow to a tip of a bow stock (pedestal) across it, pulling the string of a bow to hook it on a wire catch, locking an arrow that is thicker and shorter than a normal one called a bolt or quarrel to the string, and pulling a trigger to release the string from the wire catch, thereby shooting the arrow is basically adopted (Japanese Utility Model Application Publication Nos. 61-79793 and 58-52498).

SUMMARY OF THE INVENTION

However, in a conventionally well-known crossbow, once an arrow was shot, it took time to shoot the next arrow. Thus, only about two or three arrows were able to be shot for one minute although the number of arrows to be shot varies according to the strength of arrows.

The invention aims at providing a crossbow that enables arrows to be continuously shot with simple operation in view of such as problem.

Thus, the crossbow according to the invention is a crossbow that shoots arrows by triggering. The crossbow includes: a bow stock that has a fitting recess for a cylinder formed between a front end and a rear end thereof; a bow that is attached to the front end of the bow stock thereacross, and has a string tensioned between both ends thereof;

a wire catch that is rockably provided at the rear end of the bow stock to hook the tensioned string; a trigger that is provided at the rear end of the bow stock to cock the wire catch that has hooked the string and to release the cocking of the wire catch by triggering, thereby shooting an arrow; a cylinder that is rotatably fitted in the fitting recess of the bow stock, and has a plurality of arrow grooves formed at predetermined angular intervals in an outer peripheral surface thereof so as to extend in a longitudinal direction, and has arrows slidably inserted in the plurality of arrow grooves, respectively; and a rotation operating mechanism that rotates the cylinder at every predetermined angle, and locates one arrow groove in front of the wire catch.

One of the features of the invention is that a cylinder in which a plurality of arrows can be set is rotatably provided, and when one arrow is shot by triggering, the cylinder is rotated so that the next can be shot.

Accordingly, a plurality of arrows are set in the cylinder, the string is pulled, and is hooked, and cocked to the wire catch, and the cylinder is rotated, so that arrows can be shot one after another. In this way, arrows can be continuously shot with simple operation.

Although the string of the bow may be pulled by a hand, it is desirable that the string is pulled by a cocking device. That is, the bow stock may be further provided with a cocking device composed of pallets that hook the string of the bow on the wire catch, and an operating mechanism that may make the pallets slide rearward along the bow stock.

This cocking device may be of a type in which the string is hooked, pulled, and cocked to the wire catch by a lever provided in the bow stock as shown in Japanese Utility Model Application Publication No. 61-79793 or the following embodiments, or by a mechanism using a part similar to a grip and a butt of a rifle as shown in the following embodiments, and may be of a type in which the string is pulled backward, and is hooked on the wire catch by making a grip member slide as shown in the following embodiments so that cocking can be performed in a posture in which the crossbow is provided.

The rotation operating mechanism may be any arbitrary mechanisms as long as it can rotate the cylinder at every predetermined angle, and locate one groove in which an arrow is set in front of the cocked wire catch. For example, the rotation operating mechanism may be rotated by a hand after triggering. However, when operability is taken into consideration, it is desirable that rotation operating mechanism is operated by an operating mechanism of the cocking device so as to rotate the cylinder by a predetermined angle.

For example, it is possible to adopt a configuration in which the rotation operating mechanism has an operating lever that is rockably provided on a side surface of the rear end of the bow stock, the operating lever has a front end fitted in one arrow groove of the cylinder, and is kicked by the operating mechanism of the cocking device to rotate the cylinder by a predetermined angle, and the operating lever is separated from the arrow groove in which its front end has fit, and fits in the next adjacent arrow groove.

It is also possible to adopt a configuration in which ratchet teeth are formed in the rear end surface of the cylinder, an operating lever is provided in the rear end of the bow stock, the tip of the operating lever is meshed with the ratchet teeth, and the operating lever is rocked in conjunction with the operating mechanism of the cocking device, or the wire catch, so that the cylinder is rotated in one direction.

The bow stock may be rod-shaped. However, when an impact at the time of reflection of an arrow is taken into consideration, a shaped part similar to a grip and a butt of a rifle may be provided.

DETAIL DESCRIPTION OF THE PREFERRED EMBODIMENTS

Figure 1:
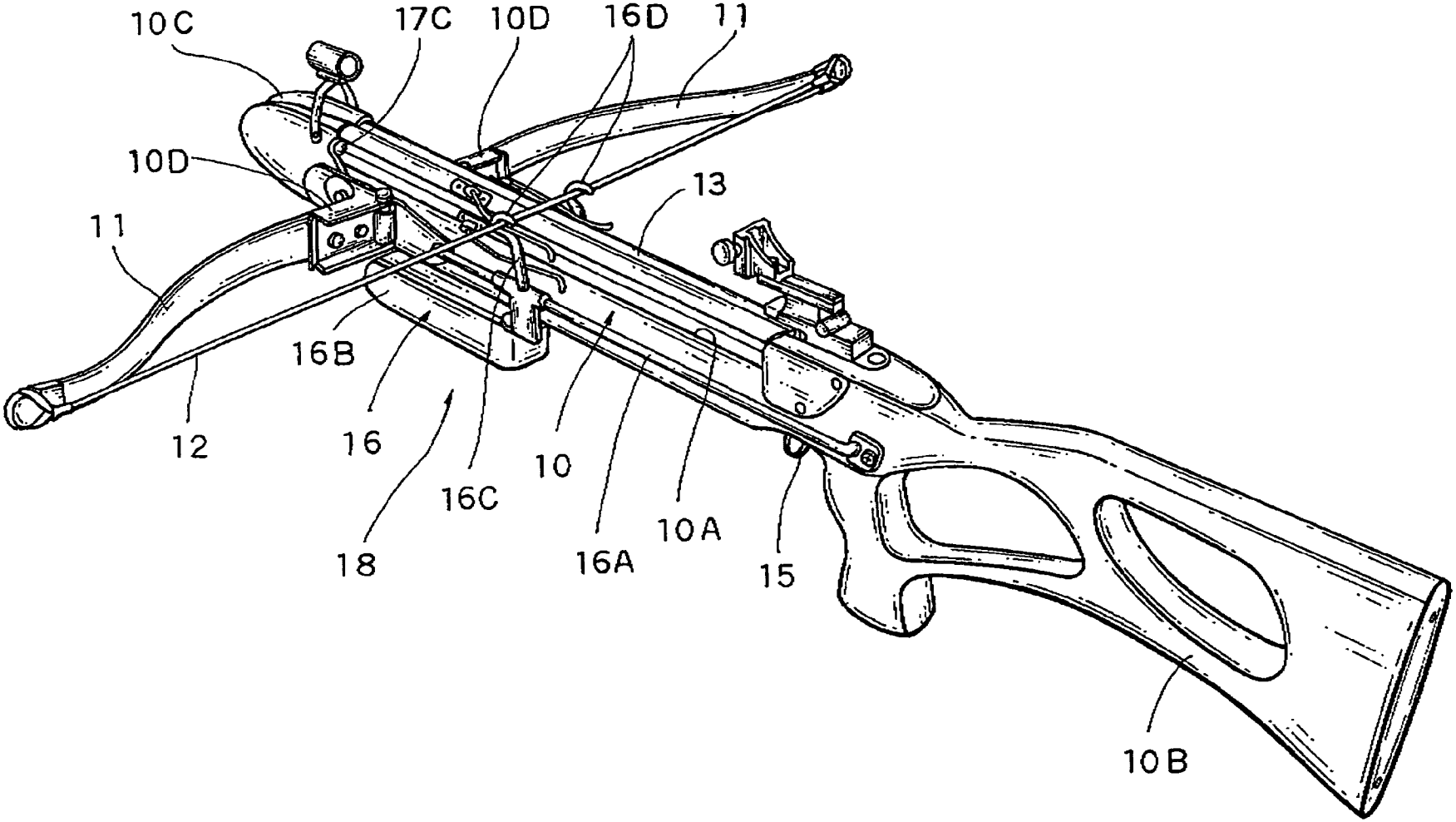
FIG. 1 is a schematic perspective view showing an overall configuration in a preferred embodiment of a crossbow according to the invention.
Figure 2:
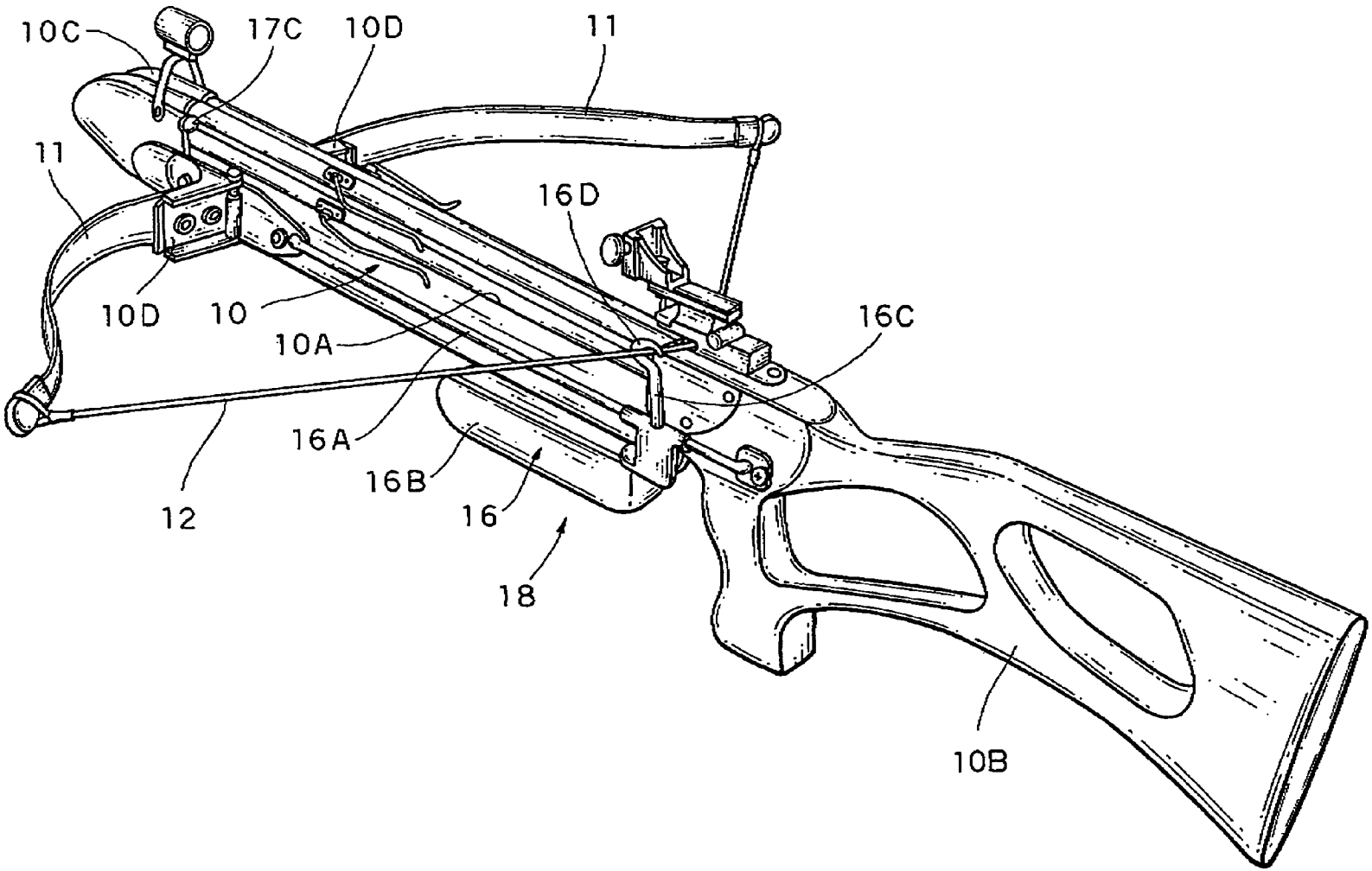
FIG. 2 is a schematic perspective view showing a state where a wire catch has been cocked in the above embodiment.
Figure 3:
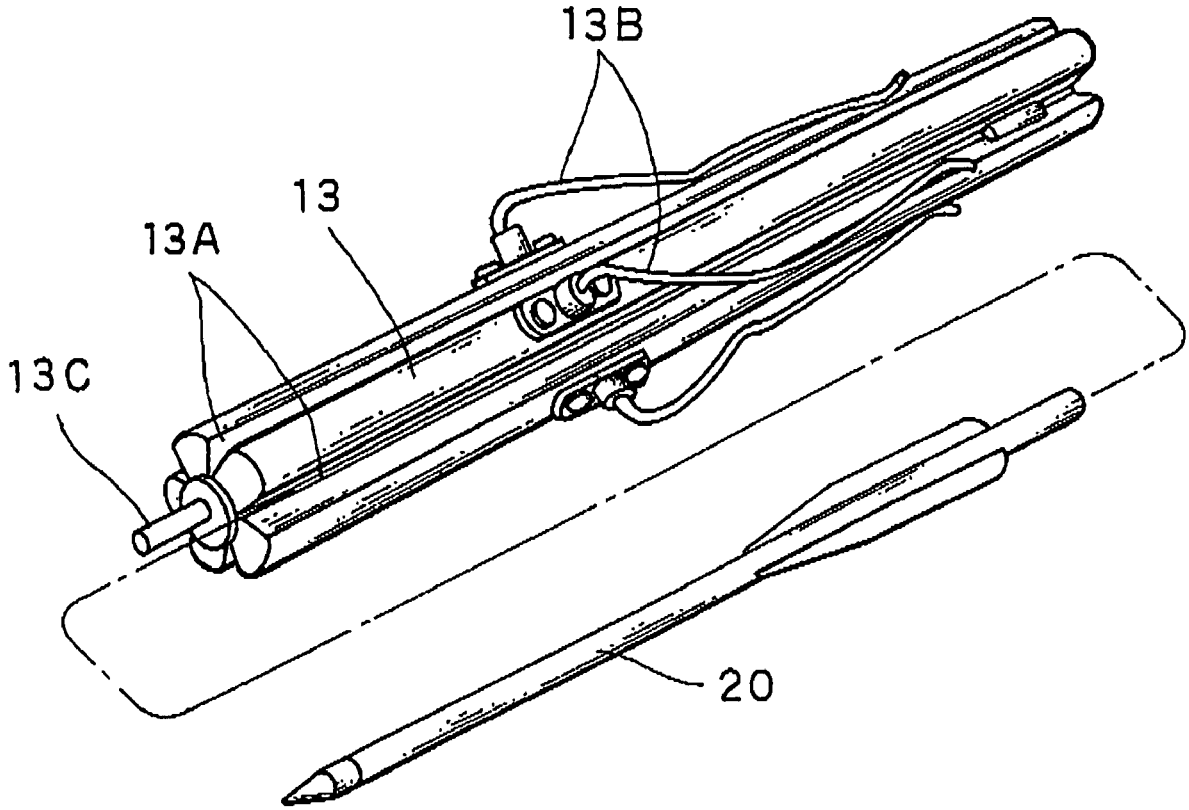
FIG. 3 is a perspective view showing one example of a cylinder and cocking of an arrow in the above embodiment.
Figure 4A:
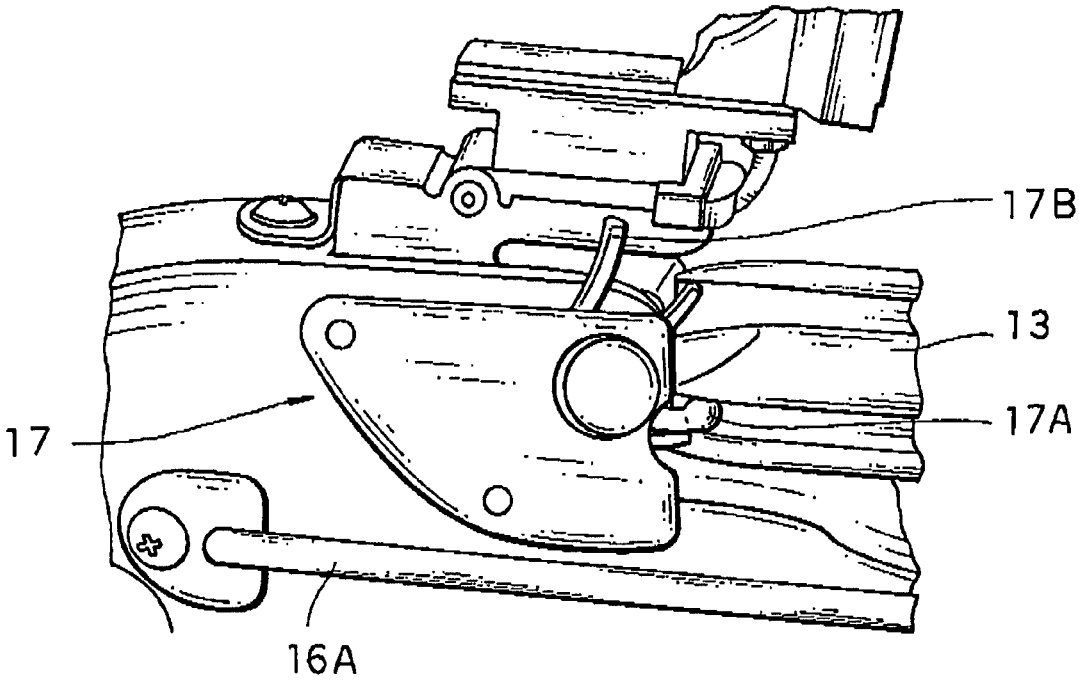
FIG. 4A is a perspective view showing a state before the cylinder of a rotation operating mechanism in the above embodiment is rotationally operated.
Figure 4B:
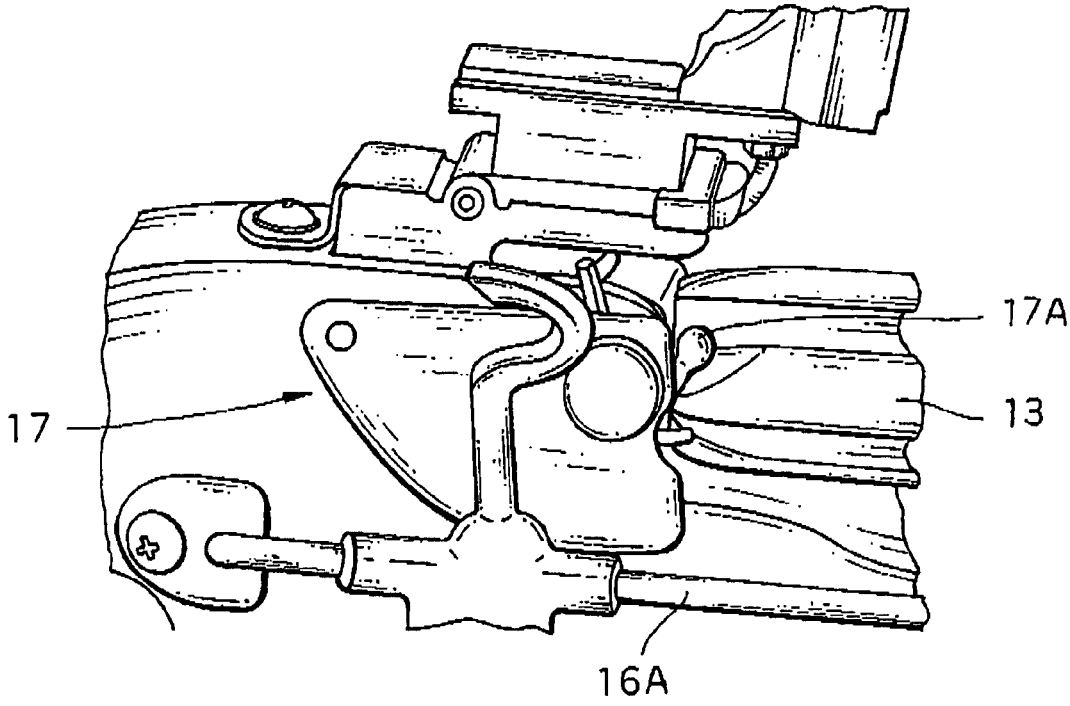
FIG. 4B is a perspective view showing a state after the cylinder of the rotation operating mechanism in the above embodiment has been rotationally operated.
Figure 5:
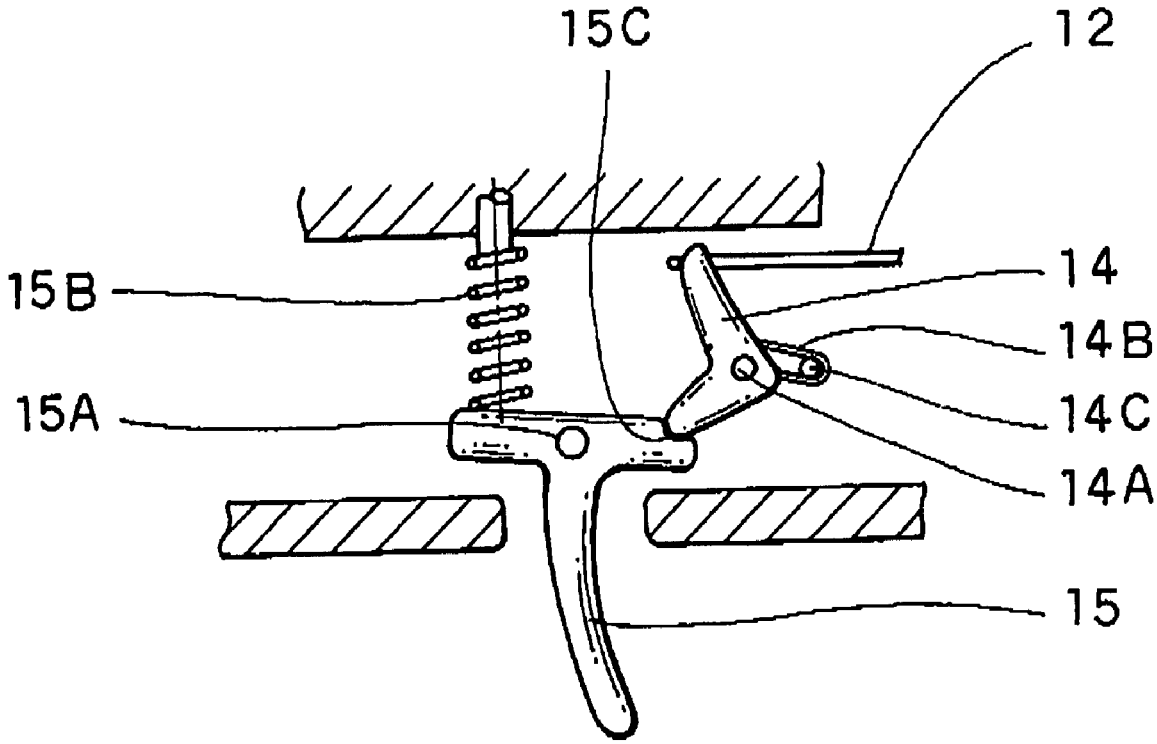
FIG. 5 is a perspective view showing one example of the wire catch and a trigger in the above embodiment.
Figure 6:
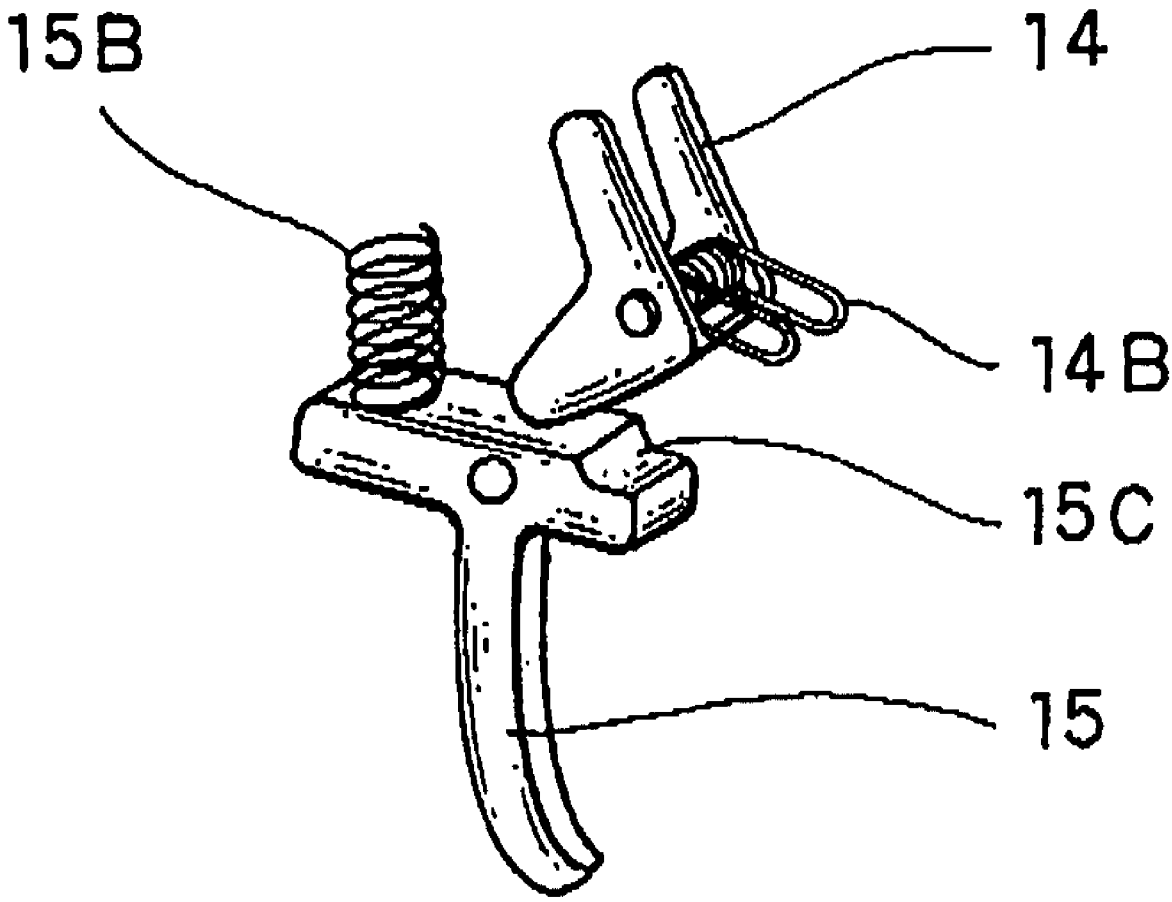
FIG. 6 is a perspective view showing the relationship between the wire catch and the trigger in the above embodiment.

Hereinafter, the invention will be described in detail on the basis of specific examples shown in the figures. FIGS. 1 to 6 show a preferred embodiment of a crossbow according to the invention. In these figures, a fitting recess 10A for a cylinder is formed between a front end and the rear end of a bow stock 10, and a shaped part 10B similar to a grip and a butt of a rifle is provided at the rear end of the bow stock 10.

A shooting groove 10C of an arrow 20 is formed in a top surface of the front end of the bow stock 10 so as to extend back and forth, and a bow 11 is attached to both side surfaces of the front end of the bow stock 10, and is attached so that it can rise or fall by a bracket 10D. In this way, the bow 11 is attached to the bow stock 10 across it. With this bow 11 being bent, a string 12 is tensioned between both ends of the bow.

The cylinder 13 is fitted in the fitting recess 10A of the bow stock 10. This cylinder 13 is formed such that a plurality of, for example five arrow grooves 13A extend in a longitudinal direction at predetermined angular intervals in an outer peripheral surface of the cylinder. Further, one end of an arrow presser bar 13B is attached to the cylinder 13, and an arrow 20 is set in the arrow groove 13A, and is pressed down by the arrow presser bar 13B. Thereby, the arrow 20 is held in a state of being set in the arrow groove 13A.

Further, attaching shafts 13C are attached to the front and rear end surfaces of the cylinder 13 in the centers thereof (it is noted that the attaching shaft of the rear end surface is not shown in the figures). The front and rear attaching shafts 13C are rotatably fitted in an attaching recess that is formed in the front end surface of the fitting recess 10A of the bow stock 10 and in an attaching hole that is formed in the rear end surface. Further, upward slip-out of the front attaching shaft 13C from the recess is prevented by a stopper pin (not shown). Thereby, the cylinder 13 is rotatably and detachably fitted in the fitting recess 10A.

Further, the wire catch 14 is built within the rear end of the bow stock 10 so as to be rotatable around a shaft 14A, a coil spring 14B is fitted on the attaching shaft 14A, the coil spring 14B is latched on a pin 14C attached to the rear end of the bow stock 10, and the wire catch 14 is rotationally biased by the coil spring 14B such that it falls rearward around the shaft 14A.

A trigger 15 is disposed below the wire catch 14, and the trigger 15 is rockably attached by an attaching pin 15A and is biased so as to rock forward by a coil spring 15B. Also, the trigger 15 is formed substantially in the shape of the letter "T", and the rear end of the wire catch 14 is latched and cocked to a tip 15C of a horizontal side of the trigger.

Moreover, the bow stock 10 is provided with a cocking device 18 composed of an operating mechanism 16 and pallets 16D. In this operating mechanism 16, right and left guide bars 16A are respectively provided on both sides of the bow stock 10. Both the guide bars 16A extend along the bow stock 10 parallel to each other, and are fixed to the front and end ends of the bow stock 10. An attaching tubular part of a grip block (grip member) 16B is slidably fitted on both the guide bars 16A whereby the grip block 16B is slidably supported by the guide bars 16A.

Arms 16C are formed integrally with the attaching tubular part of the grip block 16B. The arms 16C extend upward, and tips of the arms are formed with pallets 16D to which the string 12 of the bow 11 is hooked.

Further, the rear end of the bow stock 10 is provided with a rotation operating mechanism 17 that rotates the cylinder 13 at every predetermined angle and locates one arrow groove 13A in front of the wire catch 14. This rotation operating mechanism 17 has an operating lever 17A and a driving lever 17B. A rear end of the operating lever 17A is rotatably attached to one side surface of the rear end of the bow stock 10, and is rotationally biased by a spring member (not shown). A front end of the operating lever 17A is fitted into one arrow groove 13A located laterally of the cylinder 13.

Further, when the grip block 16B has been made to slid to the rearmost position, the operating lever 17A causes the driving lever 17B kicked rearward by the pallets 16D of the cocking device 18 to rotate by a predetermined angle, thereby causing the cylinder 13 to rotate by a predetermined angle. Thereafter, when the grip block 16B has been returned to the front and the pallets 16D has been made to slide forward, the operating lever 17A rotationally returns to its original position, and thereby the operating lever slips out of the arrow groove 13A into which the front end of the operating lever has fitted, and fits into the arrow groove 13A returned to the original position.

In addition, while the operating lever 17A is provided in the rear end of the bow stock 10, ratchet teeth are formed in the rear end surface of the cylinder 13. Thereby, the operating lever 17A can rotate the cylinder 13 in conjunction with the wire catch 14, and can be rotationally returned by a spring member.

A lower end of a locking lever 17C is attached to one side surface of the front end of the bow stock 10, and a upper end of the locking lever 17C fits into or slips out of the arrow groove 13A of the cylinder 13, so that the rotation of the cylinder 13 in one direction is allowed, and the rotation thereof in its opposite direction is regulated.

When the crossbow of this example is used, the cylinder 13 is detached, arrows 20 are inserted in a plurality of the arrow grooves 13A of the cylinder 13, respectively, and the arrows 20 are held in the arrow grooves 13A by arrow presser bars 13B. When the cylinder 13 in which the arrows 20 are set is fitted in the fitting recess 10A of the bow stock 10, front ends of the operating levers 17A and front ends of the locking levers 17C will fit into the arrow grooves 13A that turn to both sides of the cylinder 13, respectively.

The grip block 16B is made to slide to the forefront, and the string 12 of the bow 11 is hooked on the pallets 16D. At this time, since the pallets 16D are located near the string 12 tensioned in the bow 11, the string 12 can be easily hooked on the pallets 16D with a small force.

When the string 12 is caught by the pallets 16D, the grip block 16B is made to slide rearward. Then, when the string 12 is pulled rearward while the bow 11 is bent, and the grip block 16B is made to slide to the rearmost position, the string 12 rides over the upper end of the wire catch 14 while the pallets 16B topple the wire catch 14 a little rearward. Thus, when the grip block 16B is made to slide forward, the string 12 will be caught by a rear edge of the upper end of the wire catch 14.

At this time, since the wire catch 14 is latched by the trigger 15 that has been rotationally biased by the coil spring 15B and is cocked in a predetermined posture, the string 12 is held in a state of being pulled rearward.

Further, when the grip block 16B is made to slide to the rearmost position, the driving lever 17B is kicked and the operating lever 17A is rotated upward. Then, the operating lever 17A rotates the cylinder 13 by a predetermined angle, and locates an arrow groove 1A in which an arrow 20 is set in front of the wire catch 14. Simultaneously, the front end of a locking lever 17C fits into the arrow groove 13A that has rotated thereto, thereby positioning the cylinder 13.

Next, when a person hooks his/her finger on the trigger 15 and pulls the trigger 15, the cocking of the wire catch 14 is released, and the string 12 moves forward at high speed under the restoring force of bow 11, so that the arrow 20 in the arrow groove 13A of the cylinder 13 can be shot forward.

The wire catch 14 that has released the string 12 rotationally returns to its original posture by the coil spring 14B, and the trigger 15 rotationally returns to its original posture by the coil spring 15B, thereby latching the wire catch 14.

The operating lever 17A that has rotated the cylinder 13 by a predetermined angle rotationally returns to its original posture after the arrow 20 is shot, and the front end of the operating lever slips out of the arrow groove 13A in which it has fitted, and fits into an arrow groove 13A that is adjacent in the reverse rotation direction.

Thereafter, when the same operation as the above is repeated, arrows 20 can be continuously shot simply.

Figure 7:
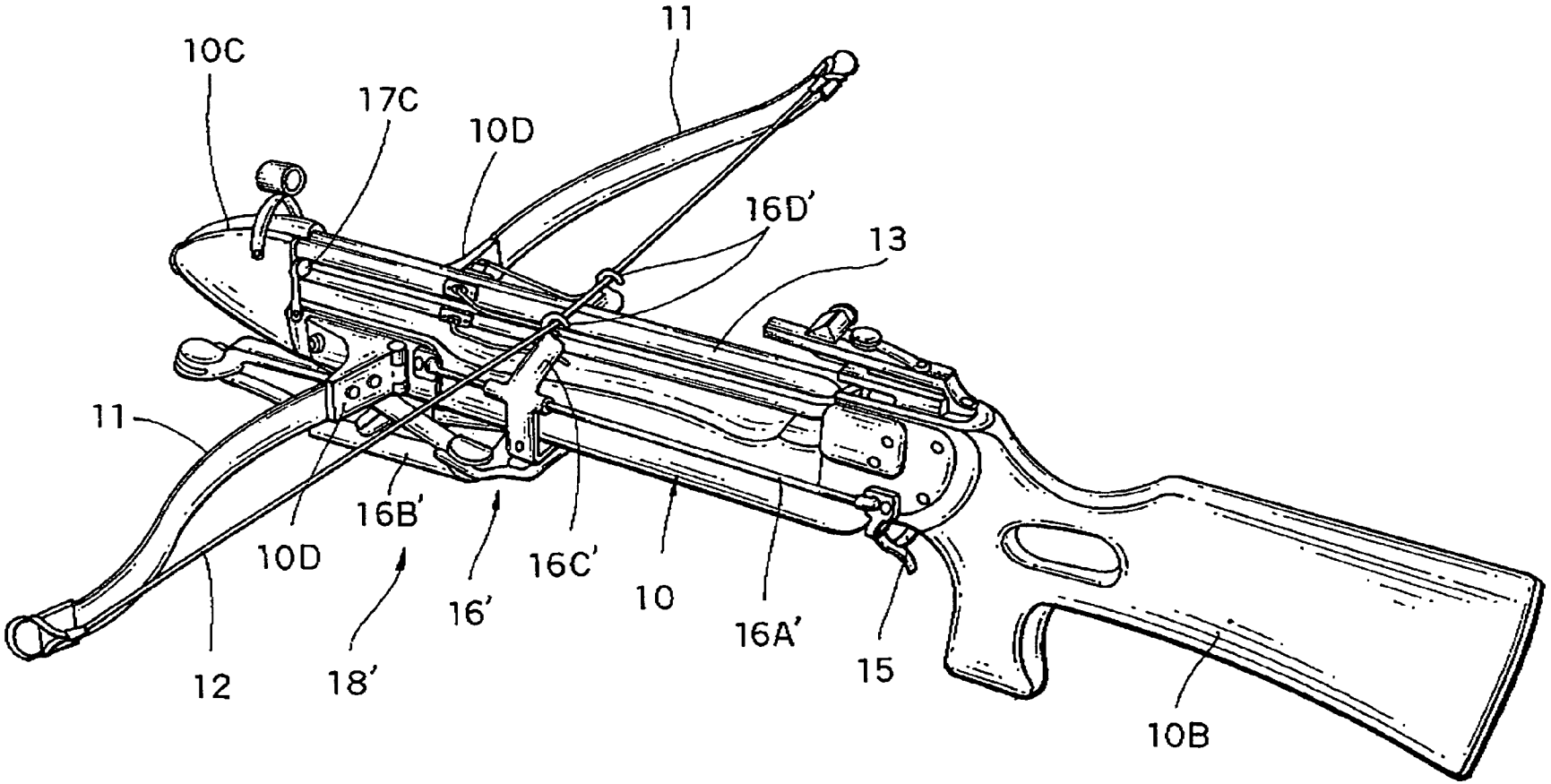
FIG. 7 is a schematic perspective view showing an overall configuration in a second embodiment.
Figure 8:
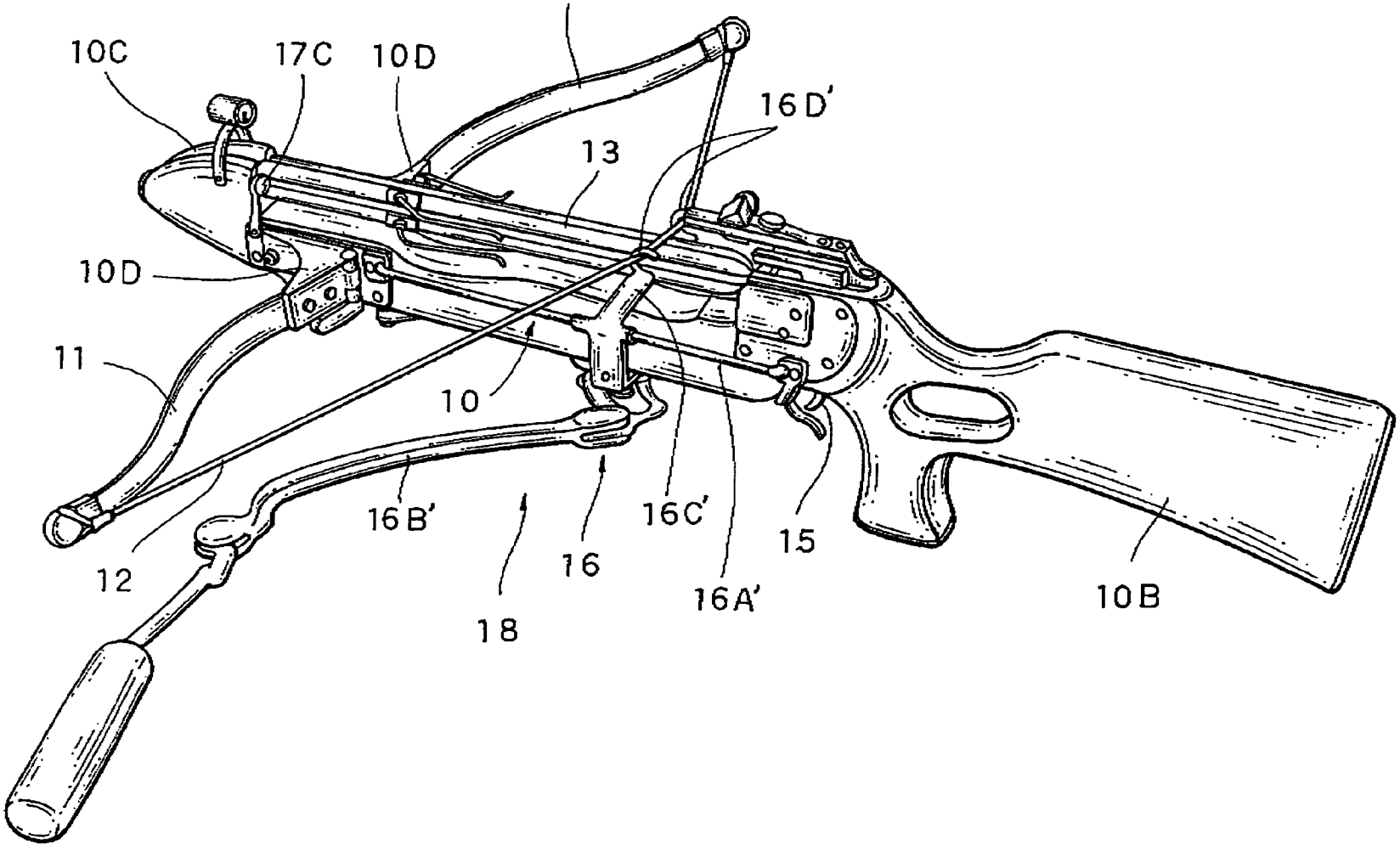
FIG. 8 is a schematic perspective view showing a state where a pallet is not being slid rearward in the above embodiment.
Figure 9:
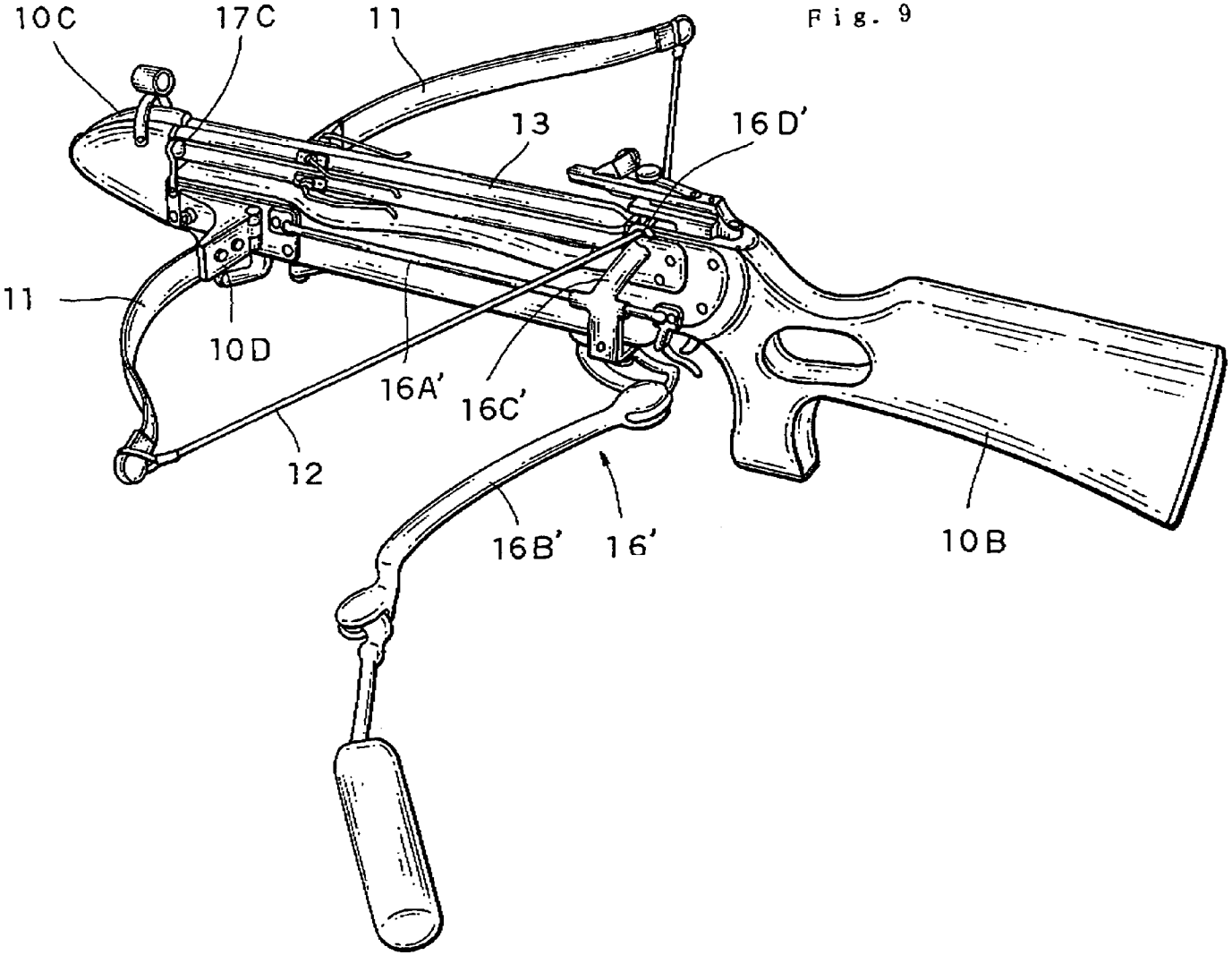
FIG. 9 is a schematic perspective view showing a state where a wire catch has been cocked in the above embodiment.

FIGS. 7 to 9 show a second embodiment. In these figures, the same reference numerals as those of FIGS. 1 to 6 represent the same or equivalents parts. In this embodiment, a cocking lever 16B' is used for an operating mechanism 16' of a cocking device 18'. Specifically, both lateral guide bars 16A of the bow stock 10 are provided, and a tubular base of the cocking lever 16B' is slidably fitted on both the guide bars 16A, and the cocking lever 16B' is foldably configured. Moreover, arms 16C' are formed integrally with the tubular base. The arms 16C' extend upward, and tips of the arms are formed with pallets 16D' to which the string 12 of the bow 11 is hooked.

In this embodiment, the folded cocking lever 16B' is made to slide to the forefront, and the string 12 of the bow 11 is hooked on the pallets 16D'. Next, when the cocking lever 16B' is unfolded, a front grip of the cocking lever 16B is gripped and pulled rearward, the pallets 16D' are pulled rearward while the string 12 bends the bow 11. Then, when the tubular base of the cocking lever 16B' is made to slide to the rearmost position, the string 12 moves to the wire catch 14 from the pallets 16B' and is hooked thereto.

Since the other operation is the same as that of the first embodiment, detailed description thereof is omitted herein.

Figure 10:
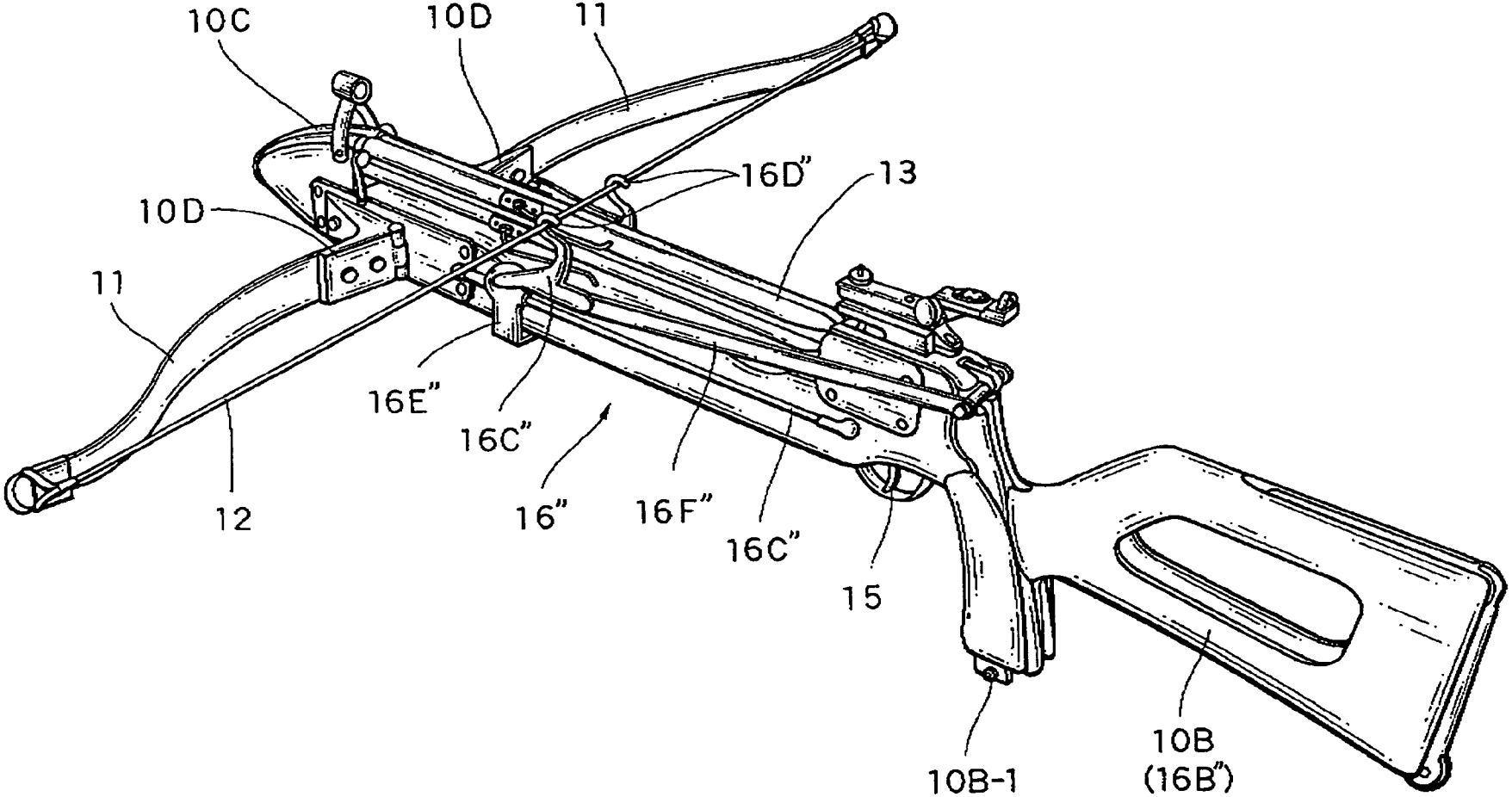
FIG. 10 is a schematic perspective view showing an overall configuration in a third embodiment.
Figure 11:
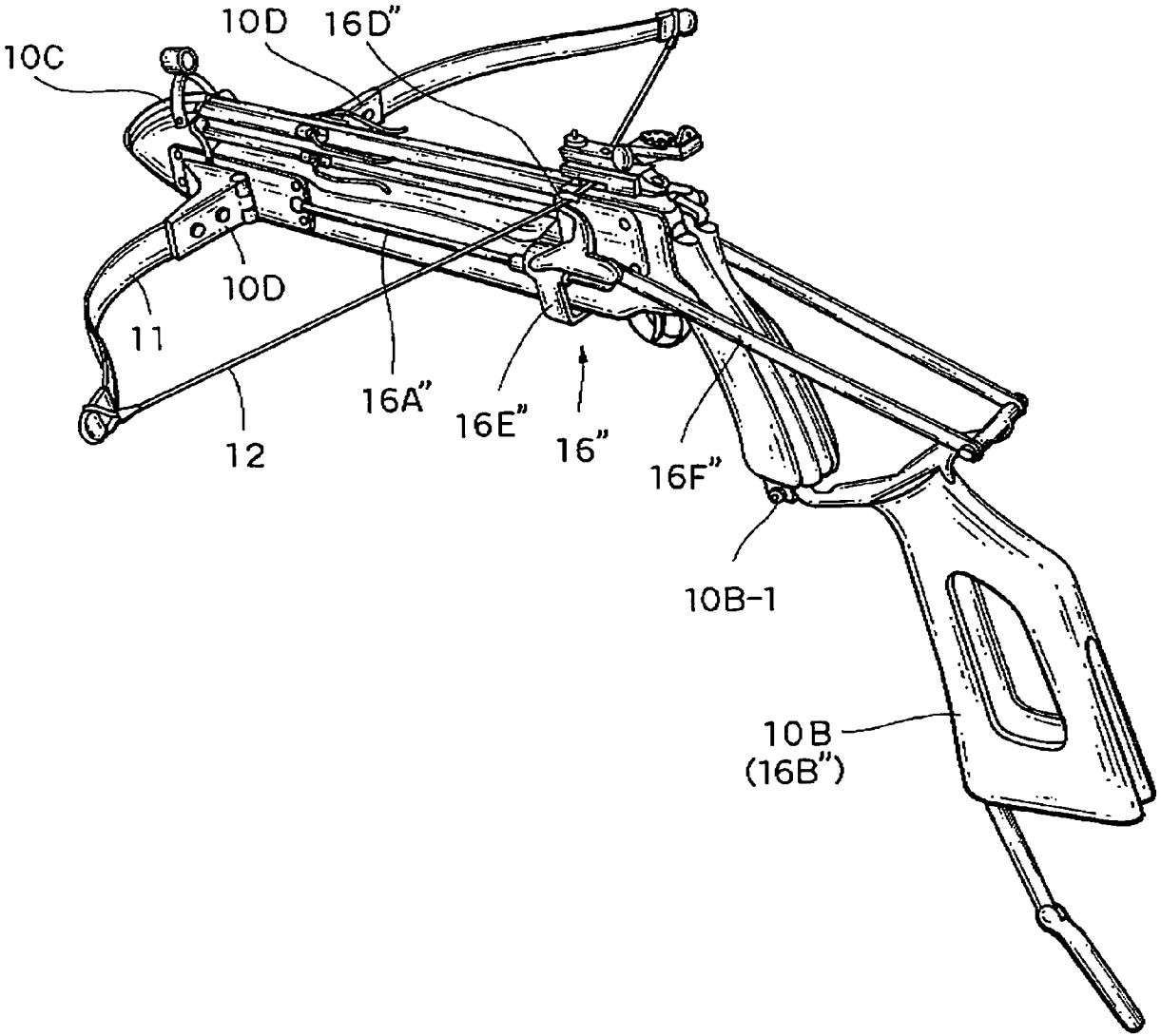
FIG. 11 is a schematic perspective view showing a state where a wire catch has been cocked in the above embodiment.

FIGS. 10 and 11 show a third embodiment. In these figures, the same reference numerals as those of FIGS. 1 to 6 represent the same or equivalents parts. In this embodiment, a shaped part 10B similar to a grip and a butt of a rifle is used for an operating mechanism 16" of a cocking device 18".

Specifically, a lower front end of the shaped part 10B similar to a grip and a butt of a rifle is provided so as to be rotatable with respect to the bow stock 10 by a shaft 10B-1. A tubular part of a slide plate 16E" is slidably fitted on both lateral guide bars 16A" of the bow stock 10. A front end of a link 16F" is fixed to the tubular part of the slide plate 16E", and a rear end of the link 16F" is connected with an upper front end of the shaped part 10B similar to a grip and a butt of a rifle.

Further, arms 16C" are formed integrally with the slide plate 16E". The arms 16C" extends upward, and tips of the arms are formed with pallets" 16D to which the string 12 of the bow 11 is hooked.

In this embodiment, when the shaped part 10B similar to a grip and a butt of a rifle is in its normal position with respect to the bow stock 10, the slide plate 16" is made to slide to the forefront. Thus, the string 12 of the bow 11 is hooked on the pallets 16D". When the shaped part 10B similar to a grip and a butt of a rifle is rotated downward around the shaft 10B-1, the slide plate 16E" is slid rearward, and the pallets 16D" are pulled rearward while the string 12 bends the bow 11. Then, when and the tubular part of the slide plate 16E" is made to slide to the rearmost position, the string 12 moves to the wire catch 14 from the pallets 16D" and is hooked thereto.

In addition, a powerful bow 11 may be configured such that a lever is detachably attached to the shaped part 10B similar to a grip and a butt of a rifle, and when the shaped part 10B similar to a grip and a butt of a rifle is rotated downward around the shaft 10B-1, the lever is pulled out as shown in FIG. 11 so that the shaped part 10B similar to a grip and a butt of a rifle can be rotated lightly.

Since the other operation is the same as that of the first embodiment, detailed description thereof is omitted herein.

This application is based on Japanese priority Application No. 2006-304702 filed on Nov. 11, 2006, and the contents of which are incorporated hereinto by reference.

What is claimed is:

1. A crossbow that shoots arrows by triggering, comprising:

a bow stock that has a fitting recess for a cylinder formed between a front end and a rear end thereof;

a bow that is attached to the front end of the bow stock thereacross, and has a string tensioned between both ends thereof;

a wire catch that is rockably provided at the rear end of the bow stock to hook the tensioned string;

a trigger that is provided at the rear end of the bow stock to cock the wire catch that has hooked the string and to release the cocking of the wire catch by triggering, thereby shooting an arrow;

a cylinder that is rotatably fitted in the fitting recess of the bow stock, and has a plurality of arrow grooves formed at predetermined angular intervals in an outer peripheral surface thereof so as to extend in a longitudinal direction, and has arrows slidably inserted in the plurality of arrow grooves, respectively;

a rotation operating mechanism that rotates the cylinder at every predetermined angle, and locates one arrow groove in front of the wire catch;

a cocking device composed of pallets that hook the string of the bow on the wire catch; and an operating mechanism that makes the pallets slide rearward along the bow stock;

wherein the rotation operating mechanism is operated by the operating mechanism of the cocking device so as to rotate the cylinder by a predetermined angle;

the rotation operating mechanism has an operating lever that is rockably provided on a side surface of the rear end of the bow stock, the operating lever has a front end fitted in one arrow groove of the cylinder, and is kicked by the operating mechanism of the cocking device to rotate the cylinder by a predetermined angle, and the operating lever is separated from the arrow groove in which its front end has fit, and fits in the next adjacent arrow groove.

2. The crossbow according to claim 1, wherein the rotation operating mechanism is operated by the operating mechanism of the cocking device so as to rotate the cylinder by a predetermined angle.

3. The crossbow according claim 2, wherein the rotation operating mechanism has an operating lever that is rockably provided on a side surface of the rear end of the bow stock, the operating lever has a front end fitted in one arrow groove of the cylinder, and is kicked by the operating mechanism of the cocking device to rotate the cylinder by a predetermined angle, and the operating lever is separated from the arrow groove in which its front end has fit, and fits in the next adjacent arrow groove.

* * * * *